US010808924B2

(12) United States Patent
Andersson et al.

(10) Patent No.: US 10,808,924 B2
(45) Date of Patent: Oct. 20, 2020

(54) METHOD FOR OPERATING A FLUIDIZED BED BOILER

(71) Applicant: Improbed AB, Malmo (SE)

(72) Inventors: Bengt-Ake Andersson, Molnlycke (SE); Pavleta Knutsson, Molndal (SE); Fredrik Lind, Torslanda (SE); Henrik Thunman, Partille (SE)

(73) Assignee: Improbed AB, Malmo (SE)

( * ) Notice: Subject to any disclaimer, the term of this patent is extended or adjusted under 35 U.S.C. 154(b) by 0 days.

(21) Appl. No.: 15/766,541

(22) PCT Filed: Nov. 7, 2016

(86) PCT No.: PCT/IB2016/056688
§ 371 (c)(1),
(2) Date: Apr. 6, 2018

(87) PCT Pub. No.: WO2017/060889
PCT Pub. Date: Apr. 13, 2017

(65) Prior Publication Data

US 2018/0283683 A1 Oct. 4, 2018

(30) Foreign Application Priority Data

Oct. 8, 2015 (EP) ..... 15189003

(51) Int. Cl.
*F23C 10/02* (2006.01)
*F23C 10/32* (2006.01)
(Continued)

(52) U.S. Cl.
CPC ..... *F23C 10/02* (2013.01); *C22B 34/1204* (2013.01); *F23C 10/00* (2013.01);
(Continued)

(58) Field of Classification Search
CPC ..... F23C 10/02; F23C 10/32; F23C 10/00; F23C 10/007; C22B 34/1204
See application file for complete search history.

(56) References Cited

U.S. PATENT DOCUMENTS 3,897,537 A 7/1975 Robinson et al.
8,252,107 B2 * 8/2012 Esmaeili ..... C04B 18/0481 106/705

FOREIGN PATENT DOCUMENTS

| | | |
|---|---|---|
| CA | 2599564 | 9/2006 |
| DE | 10 2005 012524 | 9/2006 |
| GB | 1431551 | 4/1976 |

OTHER PUBLICATIONS

Corcoran et al., Ash properties of ilmenite used as bed material for combustion of biomass in a circulating fluidized bed boiler, 2014, American Chemical Society, 28, 7672-7679 (Year: 2014).*

(Continued)

*Primary Examiner* — James A Fiorito
(74) *Attorney, Agent, or Firm* — Casimir Jones, S.C.; Mary Ann D. Brow

(57) ABSTRACT

The invention relates to a method for operating a fluidized bed boiler, comprising carrying out the combustion process with a fluidized bed comprising ilmenite particles, wherein the average residence time of the ilmenite particles in the boiler is at least 75 hours. The invention further relates to ilmenite particles obtainable by a corresponding method and the use of said ilmenite particles as oxygen-carrying material.

18 Claims, 11 Drawing Sheets

Figure 1:
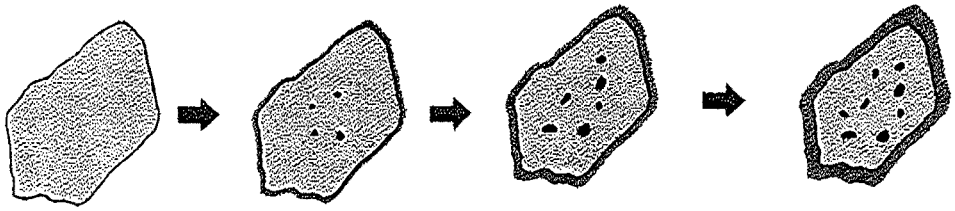

(51) Int. Cl.
*F23C 10/00* (2006.01)
*C22B 34/12* (2006.01)

(52) U.S. Cl.
CPC ..... *F23C 10/007* (2013.01); *F23C 10/32* (2013.01); *F23C 2206/102* (2013.01); *F23C 2900/10001* (2013.01)

(56) References Cited

OTHER PUBLICATIONS

Bale et al., FactSage thermochemical software and databases, Calphad, 2002, 26(2):189-228.
Thunman et al. Using an oxygen-carrier as bed material for combustion of biomass in a 12-MWth circulating fluidized-bed boiler. Fuel 2013;113:300-9.
International Search Report and Written Opinion for PCT/IB2016/056688, dated Jan. 20, 2017, 10 pages.

* cited by examiner

METHOD FOR OPERATING A FLUIDIZED BED BOILER

This application is a § 371 US National Entry of International Application No. PCT/IB2016/056688, filed Nov. 7, 2016, which claims the benefit of European Application No. 15189003.5, filed Oct. 8, 2015.

The invention is in the field of fluidized bed combustion and relates to a method for operating a fluidized bed boiler, such as a circulating fluidized bed boiler or a bubbling fluidized bed boiler, with a fluidized bed comprising ilmenite particles. The invention further relates to ilmenite particles obtainable by a corresponding method and the use of said ilmenite particles as oxygen-carrying material.

Fluidized bed combustion is a well known technique, wherein the fuel is suspended in a hot fluidized bed of solid particulate material, typically silica sand and/or fuel ash. Other bed materials are also possible. In this technique, a fluidizing gas is passed with a specific fluidization velocity through a solid particulate bed material. The bed material serves as a mass and heat carrier to promote rapid mass and heat transfer. At very low gas velocities the bed remains static. Once the velocity of the fluidization gas rises above the minimum velocity, at which the force of the fluidization gas balances the gravity force acting on the particles, the solid bed material behaves in many ways similarly to a fluid and the bed is said to be fluidized. In bubbling fluidized bed (BFB) boilers, the fluidization gas is passed through the bed material to form bubbles in the bed, facilitating the transport of the gas through the bed material and allowing for a better control of the combustion conditions (better temperature and mixing control) when compared with grate combustion. In circulating fluidized bed (CFB) boilers the fluidization gas is passed through the bed material at a fluidization velocity where the majority of the particles are carried away by the fluidization gas stream. The particles are then separated from the gas stream, e.g., by means of a cyclone, and recirculated back into the furnace, usually via a loop seal. Usually oxygen containing gas, typically air or a mixture of air and recirculated flue gas, is used as the fluidizing gas (so called primary oxygen containing gas or primary air) and passed from below the bed, or from a lower part of the bed, through the bed material, thereby acting as a source of oxygen required for combustion.

The invention is concerned with the problem of improved operation of a fluidized bed boiler, such as, e.g., a circulating fluidized bed boiler or a bubbling fluidized bed boiler.

This problem is solved by the features of the independent claims. Advantageous embodiments are defined in the dependent claims.

First, several terms are explained in the context of the invention.

The invention is directed to a method for operating a fluidized bed boiler comprising carrying out the combustion process with a fluidized bed comprising ilmenite particles, wherein the average residence time of the ilmenite particles in the boiler is at least 75 hours.

Ilmenite is a naturally occurring mineral which consists mainly of iron titanium oxide ($FeTiO_3$). Ilmenite can be repeatedly oxidized and reduced and has been used as a redox material in chemical looping combustion (CLC). From the prior art it is known to replace a fraction of the silica sand bed material with ilmenite particles in the CFB process (H. Thunman et al., Fuel 113 (2013) 300-309). Due to the reducing/oxidizing feature of ilmenite, the material can be used as oxygen carrier in fluidized bed combustion. The combustion process can be carried out at lower air-to-fuel ratios with the bed comprising ilmenite particles as compared with non-active bed materials, e.g., 100 wt.-% of silica sand or fuel ash particles.

After having experienced an initial activation phase, ilmenite particles undergo chemical aging as they are subjected to repeated redox-conditions during combustion in fluidized bed boilers and the physical interactions with the boiler structures and other fluidized particles induce mechanical wear on the ilmenite particles. It was therefore expected that the oxygen-carrying capacity of ilmenite particles and their attrition resistance rapidly deteriorate during the combustion process in a fluidized bed boiler, requiring keeping up a comparatively large supply of fresh ilmenite particles to the combustor. The invention is based on the surprise finding that this is indeed not the case.

In a first step, the invention has recognized that even after extended use as bed material in a fluidized bed boiler, ilmenite still shows very good oxygen-carrying properties and reactivity towards oxidizing carbon monoxide (CO) into carbon dioxide ($CO_2$), so called "gas conversion". In a second step, the invention has recognized that the attrition rate of the ilmenite particles surprisingly decreases after an extended residence time in the boiler and that the mechanical strength is still very good after the ilmenite has been utilized as bed material for an extended period of time.

The invention has recognized that these findings allow for average residence times of the ilmenite particles in the boiler which are at least a factor of 2.5 higher than typical residence times of bed material in conventional fluidized bed boilers. Setting the average residence time of the ilmenite particles to such long values in turn significantly reduces the overall consumption of the natural resource ilmenite and makes the combustion process more environmentally friendly and more economical.

The invention has further recognized that rock ilmenite particles exposed to the boiler conditions get smoother edges (compared to fresh ilmenite) and thereby a less erosive shape, which is less abrasive to boiler structures, such as walls, tube banks, etc. Therefore, a longer residence time of rock ilmenite particles in the boiler also improves the lifetime of these boiler structures.

In the inventive method, the average residence time of the ilmenite particles in the boiler is at least 75 hours. In preferred embodiments of the method, the average residence time of the ilmenite particles in the boiler can be at least 100 hours, further preferably at least 120 hours, further preferably at least 150 hours, further preferably at least 200 hours, further preferably at least 250 hours, further preferably at least 290 hours, most preferably at least 300 hours. Surprisingly, the invention has found that even after 296 hours of continuous operation in a fluidized bed boiler, ilmenite particles still show very good oxygen-carrying properties, gas conversion and mechanical strength, clearly indicating that even higher residence times are achievable.

In the context of the invention, the average residence time of the ilmenite particles in the boiler ($<T_{Res,ilmenite}>$) is defined as the ratio of the total mass of ilmenite in the bed inventory ($M_{ilmenite}$) to the product of the feeding rate of fresh ilmenite ($R_{feed,ilmenite}$) with the production rate of the boiler ($R_{Production}$):

$$<T_{Res,ilmenite}>=M_{ilmenite}/(R_{feed,ilmenite}\times R_{Production})$$

By way of example, if the total mass of ilmenite in the boiler is 25 tons, the feeding rate of fresh ilmenite is 3 kg/MWh and the production rate is 75 MW, this gives the average residence time $<T_{Res,ilmenite}>=25/(3\times 75/1000)$ hours=111 hours.

In the context of the invention the term fresh ilmenite denotes ilmenite that has not yet been used as bed material in the boiler. The term fresh ilmenite comprises ilmenite that may have undergone an initial oxidation or activation process.

In advantageous embodiments, the average residence time of the ilmenite particles in the boiler can be less than 600 hours, preferably less than 500 hours, further preferably less than 400 hours, further preferably less than 350 hours. All combinations of stated lower and upper values for the average residence time are possible within the context of the invention and herewith explicitly disclosed.

A fraction of the bed material fed to the combustor escapes from the boiler in the various ash streams leaving the boiler. The invention has recognized that the ilmenite particles can be separated from the respective ash streams and recycled and preferably used as oxygen-carrying material.

The invention preferably contemplates recycling of the ilmenite for use in the same boiler as well as for use in other boilers. In the former case, the average residence time of the ilmenite particles in the boiler can be increased by recirculating the ilmenite particles separated from the ash back into the boiler. In the latter case, a specific boiler can be utilized to produce activated ilmenite particles during normal boiler operation with the inventive method, and the activated ilmenite particles can then be fed to other boilers. This has, for example, the advantage that these other boilers can be partially or fully operated with activated ilmenite particles from the outset, which still possess very good oxygen carrying capacity for an extended period of time. Furthermore, activated rock ilmenite particles will have a less erosive shape than fresh ilmenite particles. However, it is also possible to utilize the recycled ilmenite particles which have been separated from the ash stream for other activities, e.g., in various applications where a need for activated ilmenite particles arises.

In a preferred embodiment of the inventive method for operating a fluidized bed boiler, the method comprises the steps:

a) removing at least one ash stream comprising ilmenite particles from the boiler;

b) separating ilmenite particles from the at least one ash stream.

Advantageously, steps a) and b) can be repeated several times. In particularly preferred embodiments, steps a) and b) can be repeated multiple times to provide a continuous stream of separated ilmenite particles.

Preferably, the at least one ash stream is selected from the group consisting of bottom ash stream, fly ash stream, boiler ash stream and filter ash stream, preferably from the group consisting of bottom ash stream and fly ash stream. Most preferably the at least one ash stream is a bottom ash stream. In advantageous embodiments of the inventive method, any combination of two or more ash streams is possible. Bottom ash is one of the major causes for the loss of bed material in fluidized bed boilers. Removal of bottom ash, i.e. ash in the bed bottom, is generally a continuous process, which is carried out to remove alkali metals (Na, K) and coarse inorganic particles/lumps from the bed and any agglomerates formed during boiler operation and to keep the differential pressure over the bed sufficient. Fly ash is that part of the ash, which is entrained from the fluidized bed by the gas and flies out from the furnace with the gas. Boiler ash is ash discharged from the boiler somewhere between the furnace and the flue gas cleaning filter. Filter ash is the ash discharged from the filter, which can normally be a bag house filter or an electrostatic precipitator (ESP). Other filters or separators are possible.

Preferably, the ilmenite particles can be magnetically separated from the at least one ash stream. The invention has recognized that the magnet attracting properties of ilmenite, which are increased by iron migration from the center to the surface of the particles, as the particles are exposed to altering redox conditions in a combustor during extended periods of time, allows for improved separation of ilmenite particles from the inert ash fraction.

Without wishing to be bound by theory, the following mechanism is contemplated. During use of the ilmenite as an oxygen carrier in the fluidized bed boiler, a natural segregation of the ilmenite phase to hematite is obtained by the outward migration of iron (Fe) and the formation of an Ferich shell around the particles. Fe-migration is a result of the diffusional processes that take place within the particles. In the ilmenite particle Fe and Ti tend to migrate towards regions high in oxygen potential, i.e. towards the surface of the particle. Iron diffuses outwards faster than titanium and at the surface it becomes oxidized. According to calculations using the program FactSage (Bale, C. W., et al., "FactSage thermochemical software and databases", Calphad, 2002, 26(2): p. 189-228) the end product after the oxidation of ilmenite is strongly influenced by temperature and oxygen potential. At temperatures above 850° C. and at high oxygen potential pseudo-brookite and hematite are the dominating phases, while at lower oxygen potential $FeTiO_3$ and $TiO_2$ are formed which would be the phases inside the particle. Further calculations on the stability of the pseudo-brookite ($Fe_2TiO_5$) phase show that upon segregation it changes to $Fe_2O_3$ and $TiO_2$ which is also the explanation of the homogeneous oxide phase formed at the edges of the particles. The process is stepwise and the thickness of the layer increases with the time of exposure, the so-called activation of the material. Since the magnetic susceptibility of the ilmenite particles increases with increasing Fe-migration to the surface of the particles, it is possible within the context of the described method to separate ilmenite particles from the at least one ash stream based on their degree of activation, e.g. by using the magnetic susceptibility of the ilmenite particles as a proxy for their degree of activation and setting appropriate magnetic threshold levels.

Ilmenite is an electric semi-conductor and the invention has further recognized that it is also possible to separate the ilmenite particles from the ash stream by employing the semi-conductor properties of ilmenite. For example, the ilmenite particles can be electrically separated from the at least one ash stream, preferably by means of electrostatic separation.

Advantageously, the method can further comprise a pre-selection step, in which the particles in the at least one ash stream are pre-selected before separating the ilmenite particles from the ash stream. Preferably the pre-selection comprises mechanical particle separation and/or fluid driven particle separation. A particularly preferred method for mechanical separation comprises sieving the particles. In fluid driven particle separation the particles are separated based on their fluid-dynamic behavior. A particularly preferred method for fluid driven separation comprises gas driven particle separation. The pre-selection step described above can, e.g., be utilized to preselect particles in the ash stream based on the particle size and/or particle mass before further separating ilmenite particles from the pre-selected ash stream. This optional pre-selection step is particularly advantageous when the fluidized bed boiler is operated with a fuel type, such as, e.g., waste, which leads to a high ash content (so-called high ash fuel), e.g. 20-30 wt-% ash with respect to the total weight of the fuel.

As explained above, the ilmenite separated from the at least one ash stream may be used for downstream activities, e.g. in another boiler or in further applications with the need for activated ilmenite particles.

Alternatively, the ilmenite separated from the at least one ash stream may be recirculated into the boiler, which helps to increase the average residence time of the ilmenite particles in the boiler.

Preferably, the method of operating a fluidized bed boiler comprises c) recirculating separated ilmenite particles into the bed of the fluidized bed boiler;

wherein preferably step c) is carried out multiple times. It is particularly preferred if steps a), b) and c) are carried out multiple times, preferably to provide a continuous recirculation of ilmenite particles separated from the at least one ash stream into the bed of the fluidized bed boiler. This recycling of ilmenite significantly reduces the need for feeding fresh ilmenite particles to the boiler.

Preferably, the recirculation frequency of ilmenite is set in accordance with the desired average residence time of the ilmenite particles in the boiler. Within the context of the described method, it is contemplated to switch between recirculation of ilmenite particles into the bed of the fluidized bed boiler and discharge of the ilmenite particles separated from the at least one ash stream for use in further activities, e.g., for use in another boiler and/or for use in applications which require activated ilmenite. Furthermore, it is also contemplated to recirculate a first fraction of the ilmenite particles separated from the at least one ash stream into the bed of the fluidized bed boiler and to discharge a second fraction of ilmenite particles separated from the at least one ash stream for use in further activities, e.g., as described above. Recirculation and discharge of the ilmenite particles may take place in parallel or in sequence and involve the same or different ash streams. For example, an advantageous embodiment comprises recirculating ilmenite particles separated from the bottom ash stream into the bed of the fluidized bed reactor, while ilmenite particles separated from the fly ash stream are discharged for further use in different applications. Preferably, recirculating and/or discharging the ilmenite particles can be based on their size and/or degree of activation.

Preferably, the method may comprise feeding fresh ilmenite particles to the boiler at a rate compensating for ilmenite lost with the removal of an ash stream from the boiler; wherein preferably the removed ash stream comprises fly ash and/or bottom ash.

Within the context of the invention, the fluidized bed boiler may be operated with a bed consisting of ilmenite particles or containing ilmenite particles as a fraction of the bed material. Preferred ilmenite concentrations in the bed are between 10 wt. % and 95 wt %, more preferably between 50 wt.-% and 95 wt. %, more preferably between 75 wt.-% and 95 wt.-%. In preferred embodiments, the bed material may consist essentially of ilmenite particles. In the context of the invention, the term consisting essentially of allows for the bed material containing a certain amount of fuel ash.

Furthermore, the invention is directed to ilmenite particles, obtainable by a method comprising:

a) providing fresh ilmenite particles as bed material to a fluidized bed boiler;

b) carrying out a combustion process with the fluidized bed boiler; wherein the average residence time of the ilmenite particles in the boiler is at least 75 hours;

c) removing ilmenite particles from the boiler.

The fluidized bed boiler may be any type of fluidized bed boiler, preferably a bubbling fluidized bed boiler or a circulating fluidized bed boiler.

In preferred embodiments, the average residence time of the ilmenite particles in the boiler can be at least 100 hours, further preferably at least 120 hours, further preferably at least 150 hours, further preferably at least 200 hours, further preferably at least 250 hours, further preferably at least 290 hours, most preferably at least 300 hours. As explained above, a surprise finding of the invention is that even after 296 hours of continuous operation in a fluidized bed boiler, the ilmenite particles still show very good gas conversion and mechanical strength. Furthermore, the invention has recognized that rock ilmenite particles exposed to the boiler conditions get smoother edges (compared to fresh ilmenite) and thereby a less erosive shape.

In advantageous embodiments, the average residence time of the ilmenite particles in the boiler can be less than 600 hours, preferably less than 500 hours, further preferably less than 400 hours, further preferably less than 350 hours. All combinations of stated lower and upper values for the average residence time are possible within the context of the invention and herewith explicitly disclosed.

The ilmenite particles can be removed from the boiler after and/or during the combustion process. In particular, the removal of ilmenite particles from the boiler can preferably take place as described above in the context of the inventive method. In fact, it should be noted that all the features described above in the context of the inventive method for operating a fluidized bed boiler can individually or in combination find use in the context of producing the inventive ilmenite particles.

A surprise finding of the invention is that the ilmenite particles of the invention can be used as oxygen-carrying material, even though they have been subjected to the boiler conditions for an extended period of time. The invention is therefore also directed to the use of the above described ilmenite particles as oxygen-carrying material. A particular advantage of this use is that the inventive ilmenite particles are already activated and have a less erosive shape than fresh ilmenite particles, thereby resulting in reduced mechanical wear of the application equipment. Preferably, the use comprises the use as oxygen-carrying bed material in a fluidized bed boiler, such as a bubbling fluidized bed boiler or a circulating fluidized bed boiler.

In the following, advantageous embodiments will be explained by way of example.

Figure 2:
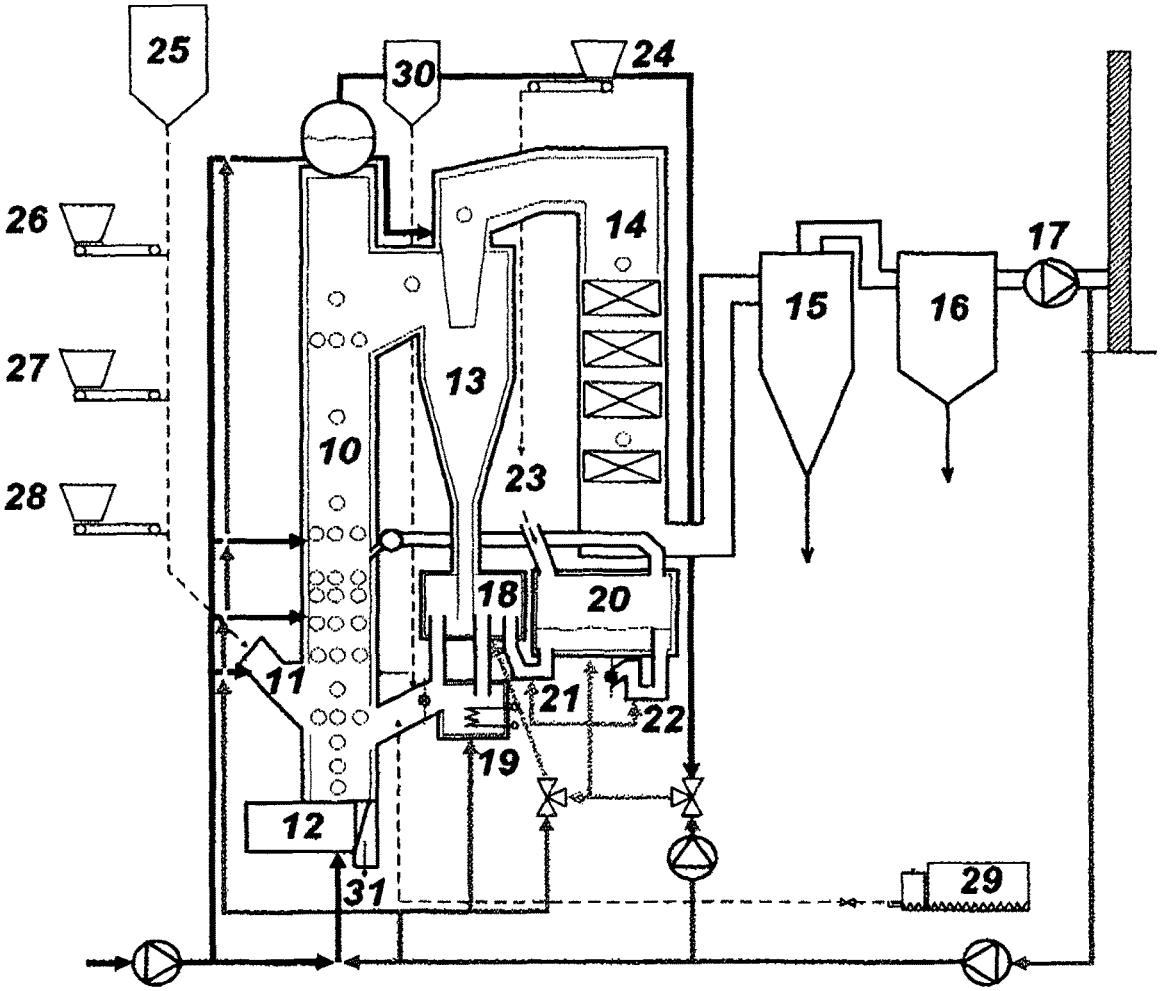
Figure 3:
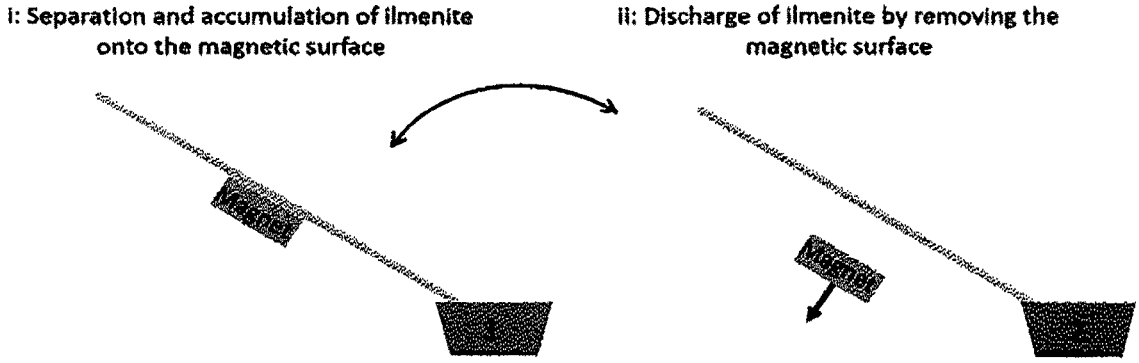
Figure 4:
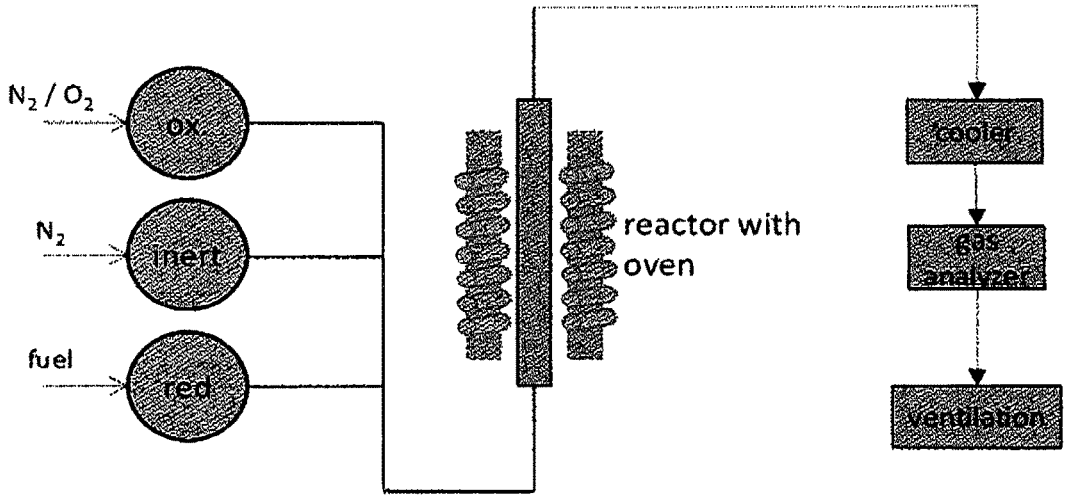
Figure 5:
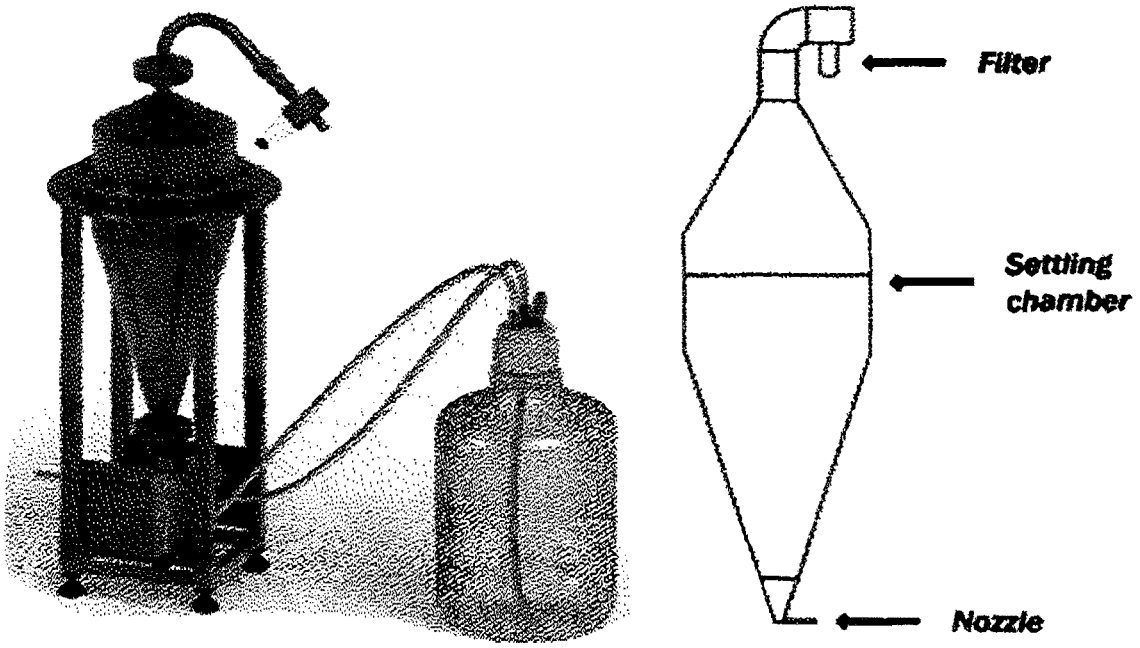
Figure 6:
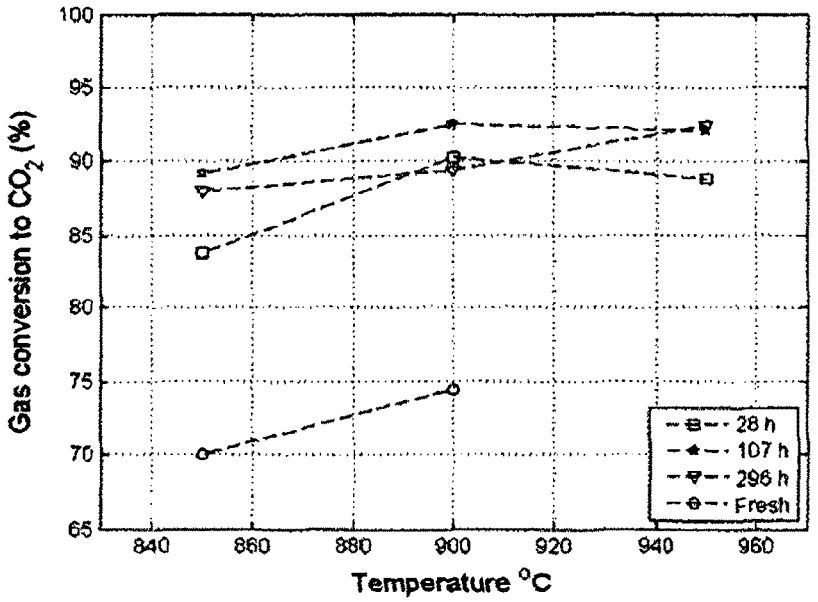
Figure 7:
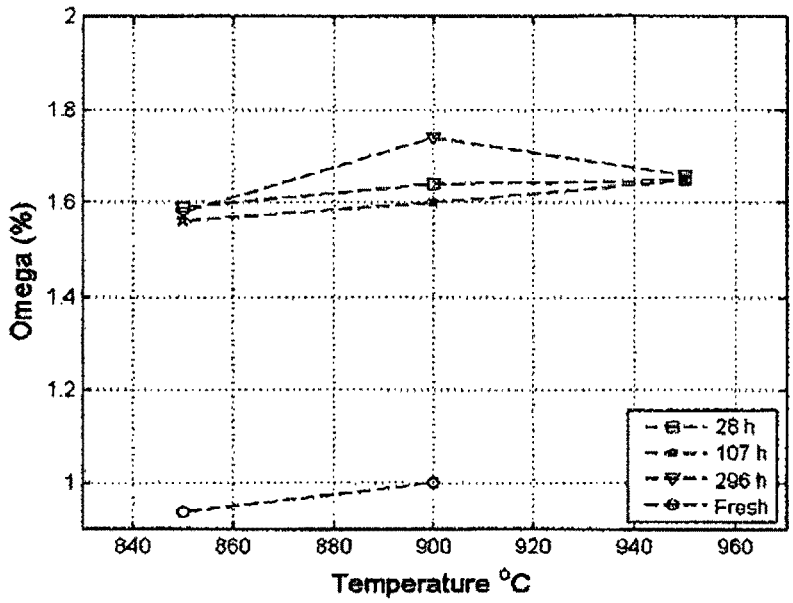
Figure 8:
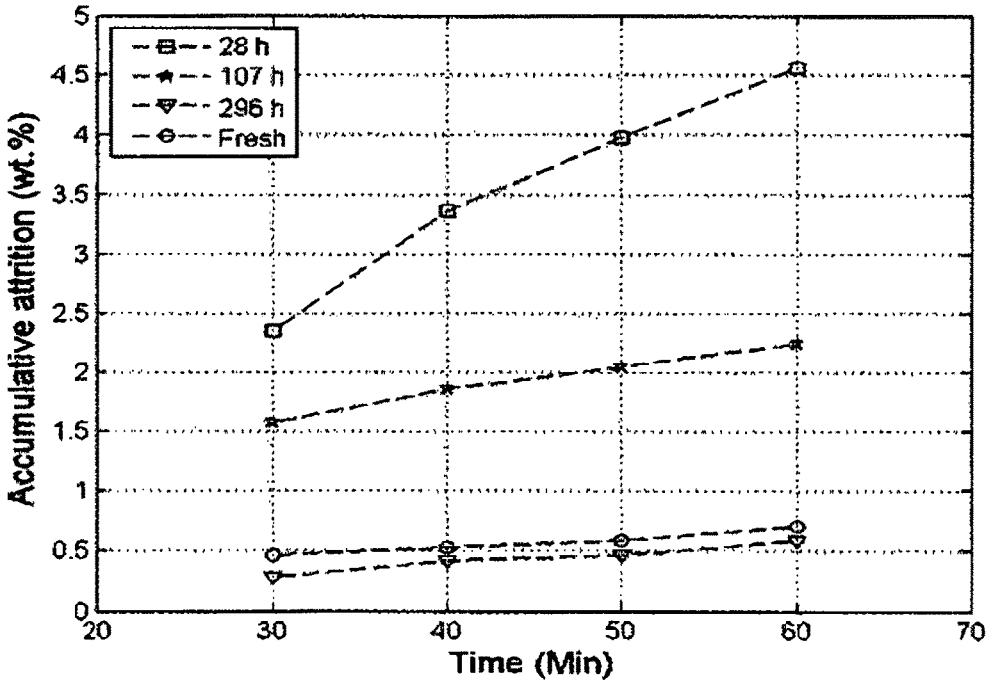
Figure 9:
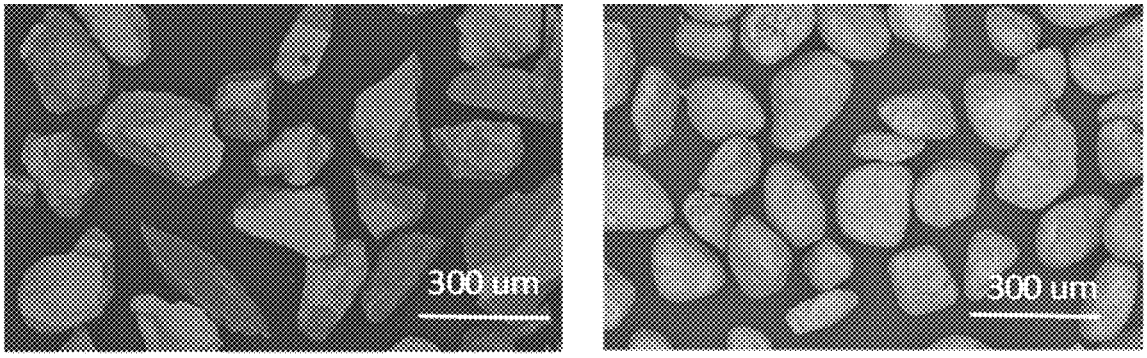
Figure 10:
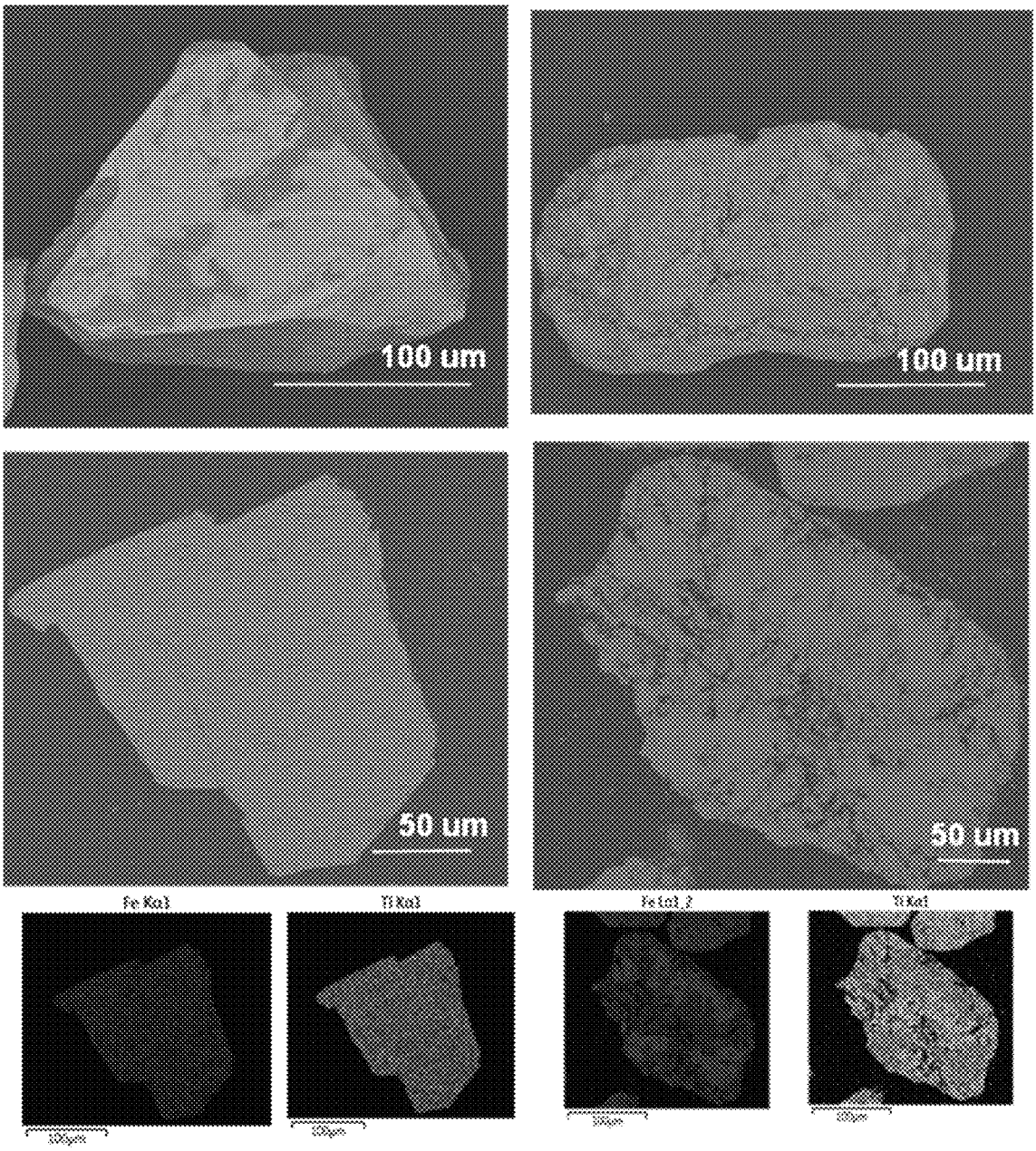
Figure 11:
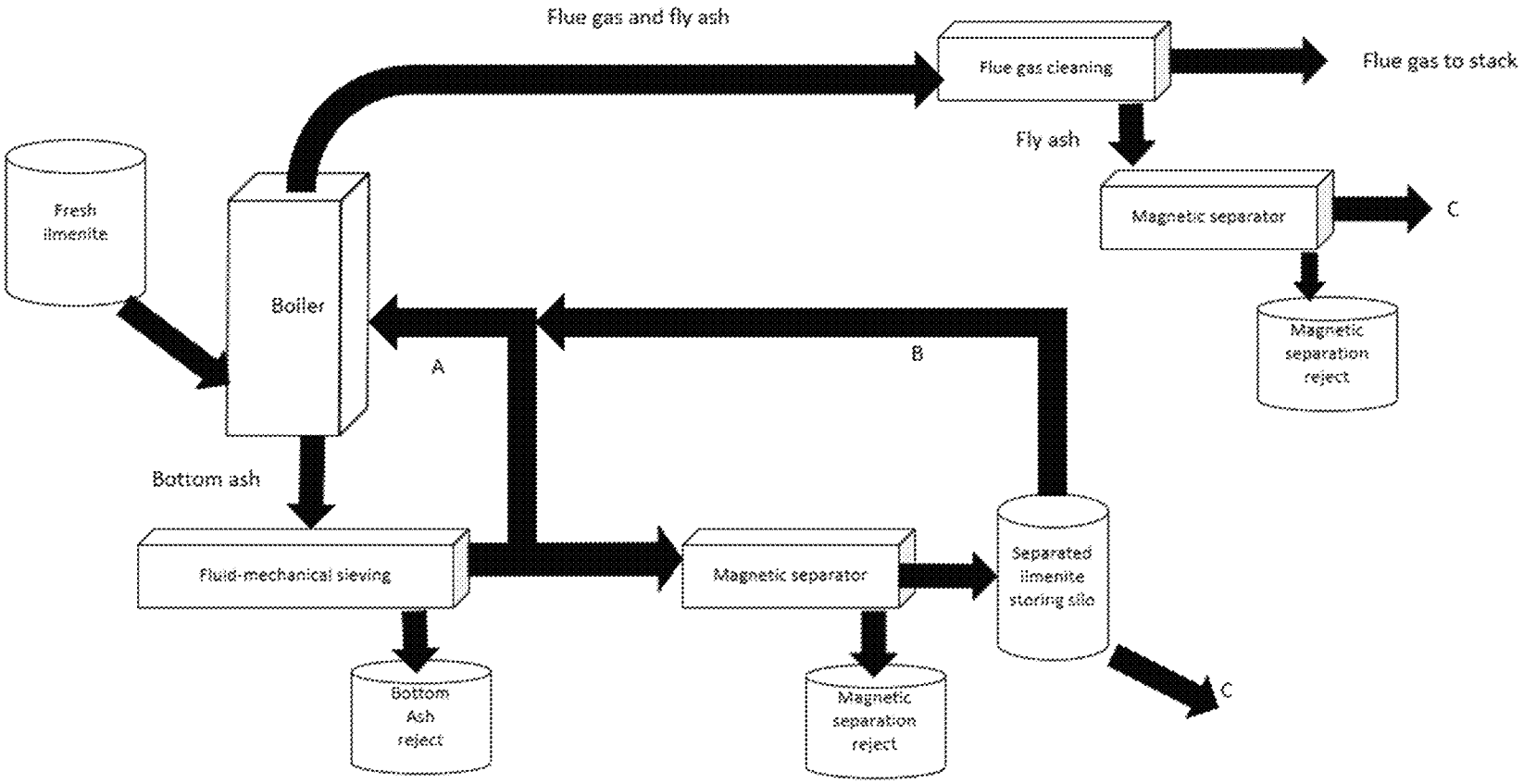
Figure 12:
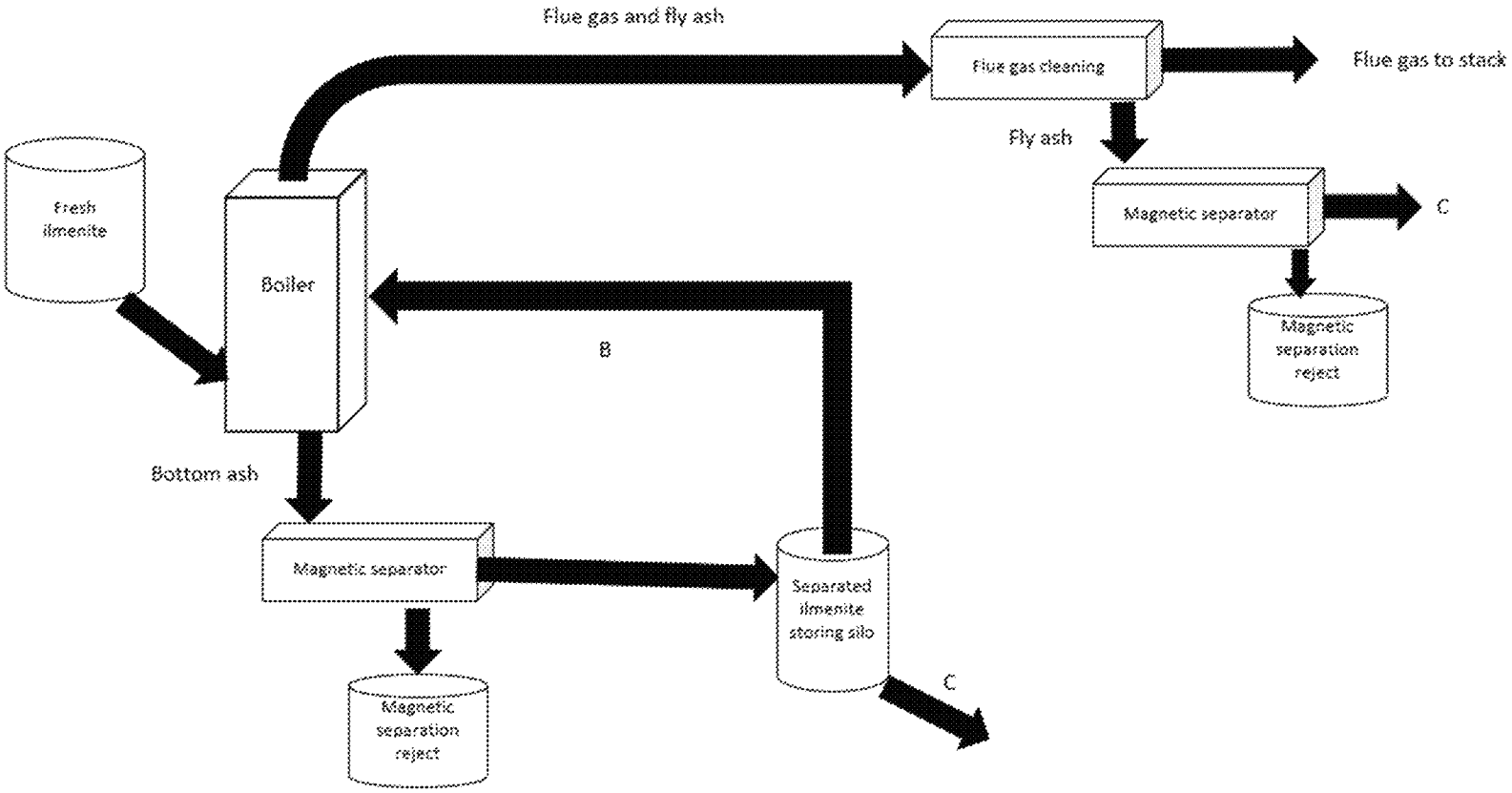
Figure 13:
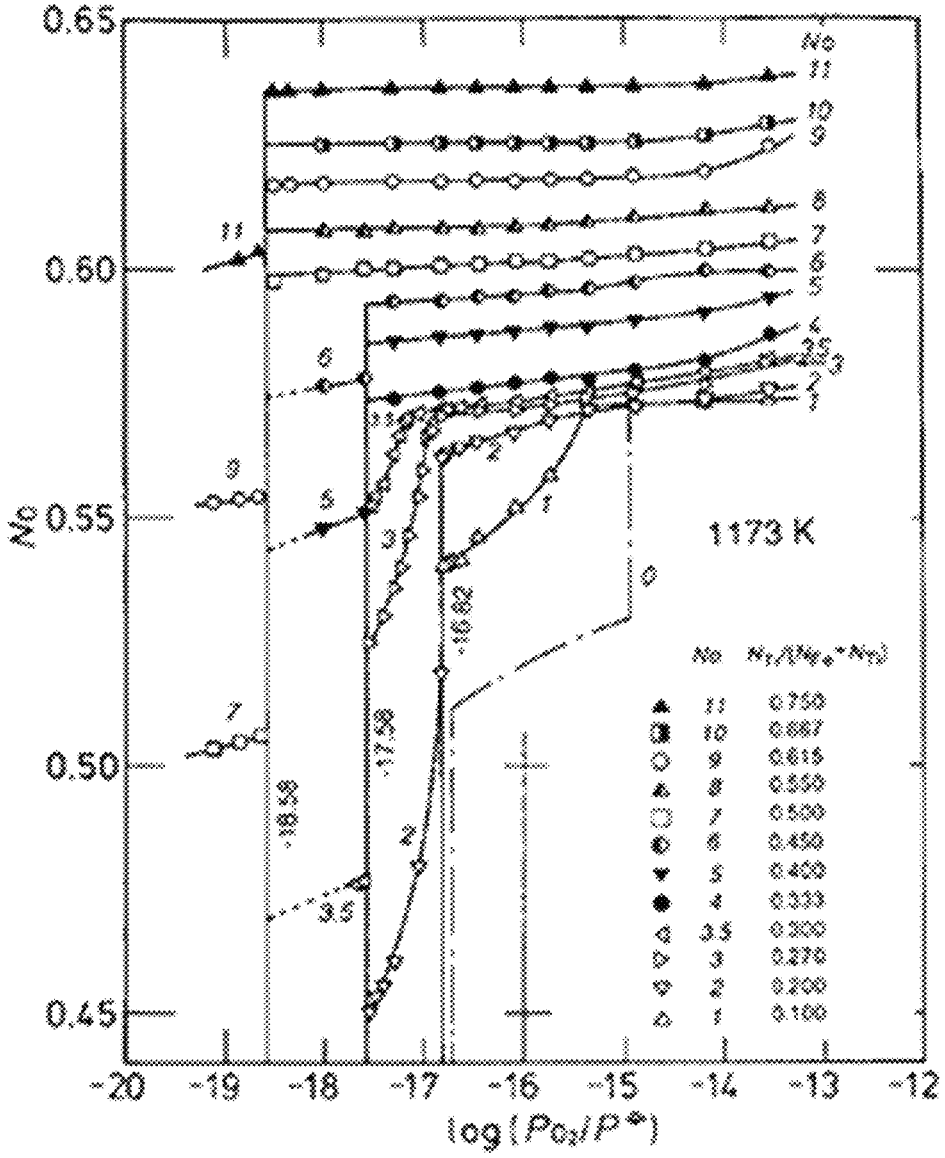
Figure 14:
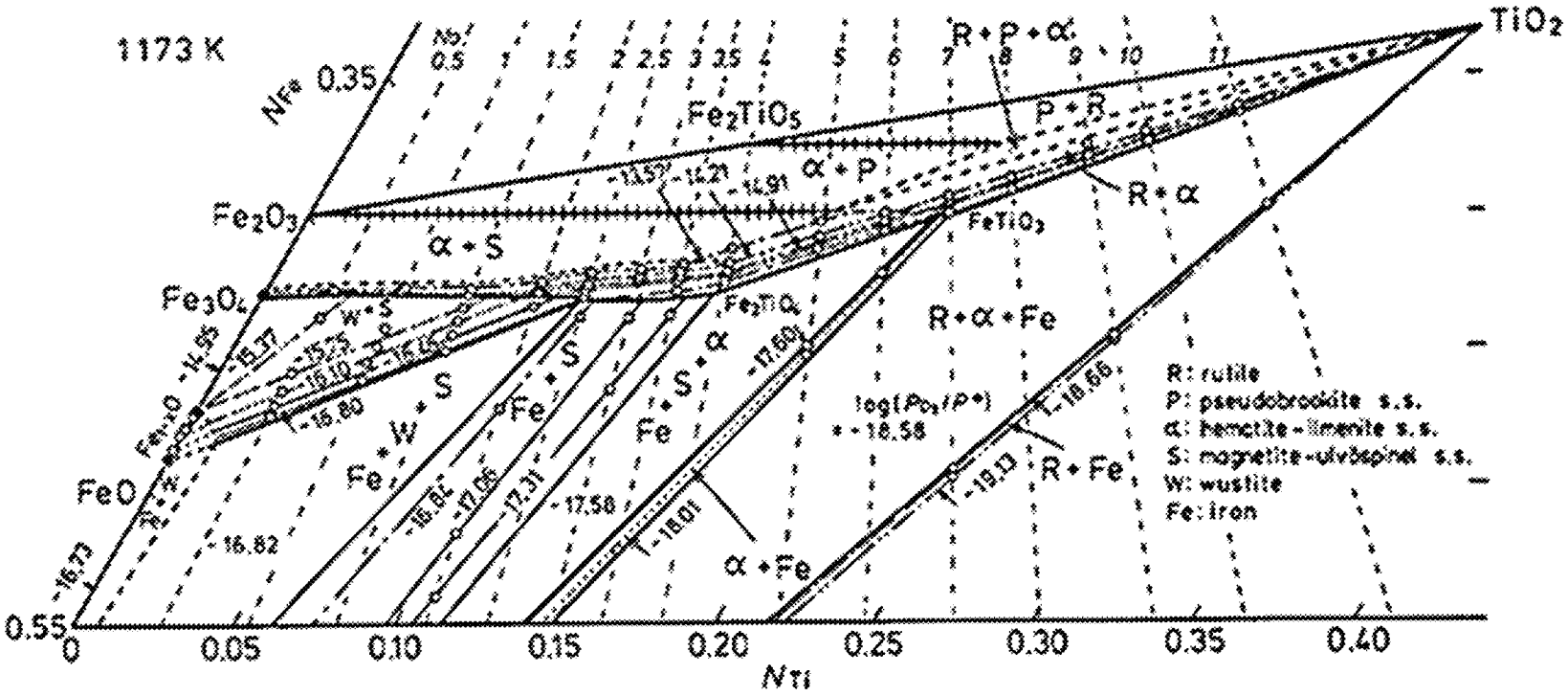
Figure 15:
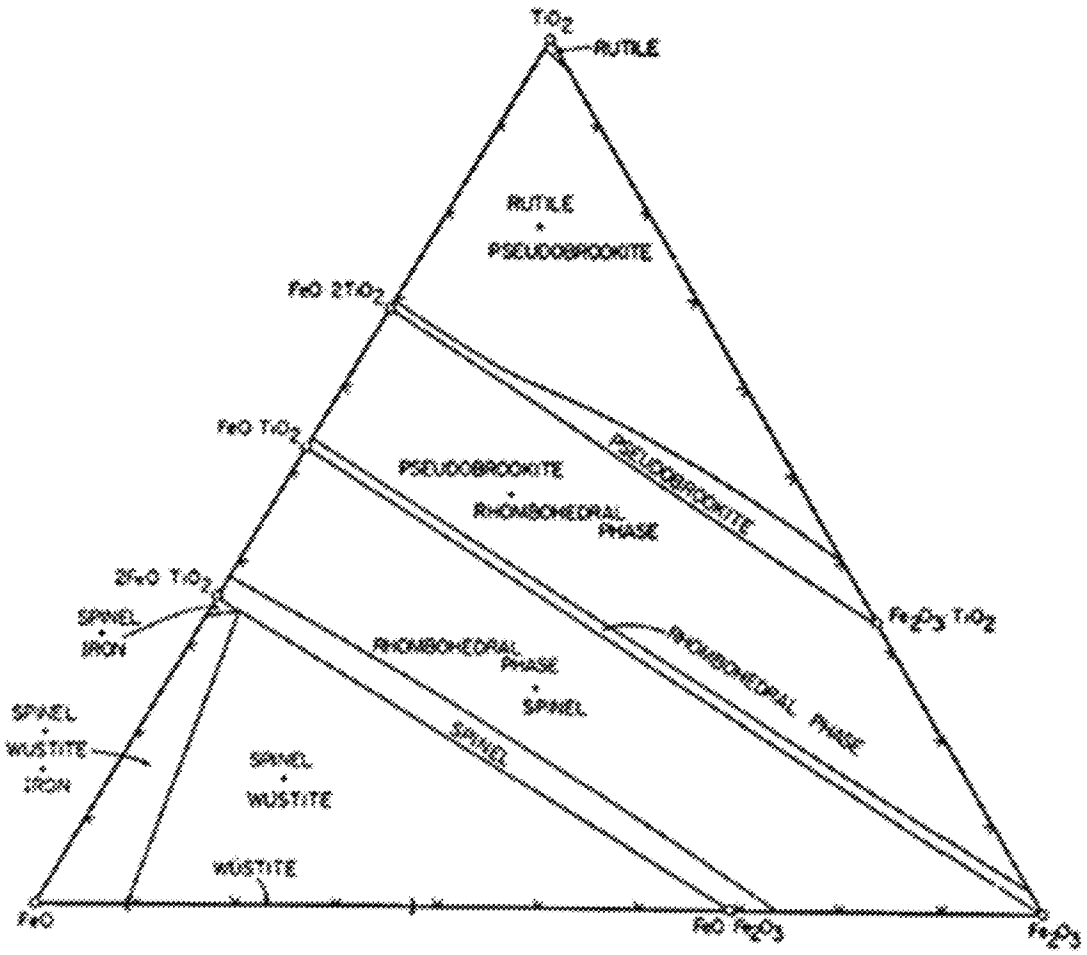

It is shown in:

FIG. 1: a schematic illustration of the outward diffusion of Fe and the formation of Fe-shell around ilmenite particles exposed to combustion conditions in a fluidized bed boiler;

FIG. 2; a schematic picture of the boiler and gasifier system at Chalmers University of Technology;

FIG. 3: a schematic picture of the procedure for magnetic separation of ilmenite particles from ashes using bottom bed samples from a commercial fluidized bed boiler;

FIG. 4: a schematic picture of the lab scale reactor system employed for ilmenite tests;

FIG. 5: equipment for determining attrition rate of particles;

FIG. 6: average gas conversion of CO to $CO_2$ at 850, 900 and 950° C., for bed materials used within the Chalmers boiler and samples after 28 hours of operation, 107 hours of operation and 296 hours of operation and for fresh ilmenite particles activated in the lab reactor;

FIG. 7: average oxygen carrier mass-based conversion at 850, 900 and 950° C., for bed materials used within the Chalmers boiler and sampled after 28 hours of operation, 107 hours of operation and 296 hours of operation and for fresh ilmenite activated in the lab reactor;

FIG. 8: performance parameters used for mechanical strength evaluation for the bed materials used within the Chalmers boiler and sampled after 28 hours of operation, 107 hours of operation and 296 hours of operation;

FIG. 9: electron micrographs of fresh ilmenite particles (left) and ilmenite particles that have been used as bed material in a CFB boiler after 24 h of operation (right);

FIG. 10: electron micrographs of ilmenite particles before (left) and after exposure in a lab scale fluidized bed reactor (right); and FIG. 11: a schematic exemplary fluidized bed combustion system;

FIG. 12: another schematic exemplary fluidized bed combustion system;

FIG. 13: a phase diagram from FactSage computer calculations;

FIG. 14: a phase diagram from FactSage computer calculations;

FIG. 15: a phase diagram from FactSage computer calculations.

EXAMPLE 1

By way of example, FIG. 11 shows a schematic diagram of a preferred fluidized bed boiler set-up.

The boiler is operated by carrying out the combustion process with a fluidized bed comprising ilmenite particles. The average residence time of the ilmenite particles in the boiler is set to at least 75 hours, preferably to at least 100 hours, further preferably at least 120 hours, further preferably at least 150 hours, further preferably at least 200 hours, further preferably at least 250 hours, further preferably at least 290 hours, most preferably at least 300 hours.

Furthermore, the average residence time of the ilmenite particles in the boiler can preferably be set to less than 600 hours, further preferably less than 500 hours, further preferably less than 400 hours, further preferably less than 350 hours.

Preferably, the bottom ash comprising ilmenite particles is removed from the boiler (typically via a bottom ash removal system).

Further preferably, the bottom ash stream can optionally be pre-treated to select particles in the ash stream based on their size, preferably by fluid-mechanical sieving. This pre-selection step is advantageous when the fluidized bed boiler is operated with a fuel type, such as, e.g., waste, which leads to a high ash content, e.g. 20-30 wt-% ash with respect to the total weight of the fuel. Pre-selection is optional and FIG. 12 shows a schematic diagram of a preferred fluidized bed boiler set-up without this step.

Further preferably, the flue gas is also cleaned to remove fly ash which comprises ilmenite particles. Preferably, ilmenite particles are separated from the bottom ash and fly ash streams by means of magnetic separators. Another preferred option for separation of ilmenite particles from the ash stream is the use of electrostatic separators.

FIGS. 11 and 12 diagrammatically show a preferred location of the magnetic separators in a fluidized bed combustion set-up along with a preferred location for the optional pre-selection device.

Preferably, the steps of removal of the ash streams from the boiler and separation of the ilmenite particles from the ash streams are carried out multiple times to provide a continuous stream of separated ilmenite particles.

Preferably, the separated ilmenite particles are recirculated into the bed of the fluidized bed boiler as indicated in FIG. 11 and FIG. 12. Route B in FIGS. 11 and 12 indicates a preferred recirculation route into the boiler of ilmenite particles separated magnetically from the bottom ash stream, preferably after having undergone optional fluid-mechanical sieving (FIG. 11).

Route A shown in FIG. 11 indicates a possible recirculation route into the boiler of bed material separated only by fluid-mechanical sieving from the bottom ash stream.

Preferably, the average residence time of the ilmenite particles in the boiler is set by adjusting the feeding rate of fresh ilmenite and the recirculation rate of separated ilmenite.

Another preferred option is to discharge all or a fraction of the separated ilmenite particles for use in further activities as diagrammatically indicated in FIG. 11 and FIG. 12 by route C. In addition to the routes for the bottom ash stream, FIGS. 11 and 12 also indicate a preferred removal of a fly ash stream in the flue gas cleaning plant and subsequent magnetic separation of the ilmenite particles from the fly ash. Preferably, the ilmenite particles separated from the fly ash, due to their small size, are not recirculated into the boiler but discharged via Route C for use in other applications.

EXAMPLE 2

The Chalmers 12 $MW_{th}$ CFB-boiler is shown in FIG. 2. Reference numerals denote:

10 furnace
11 fuel feeding (furnace)
12 wind box
13 cyclone
14 convection path
15 secondary cyclone
16 textile filter
17 fluegas fan
18 particle distributor
19 particle cooler
20 gasifier
21 particle seal 1
22 particle seal 2
23 fuel feeding (gasifier)
24 fuel hopper (gasifier)
25 hopper
26 fuel hopper 1
27 fuel hopper 2
28 fuel hopper 3
29 sludge pump
30 hopper
31 ash removal
32 measurement ports A 300 hour long combustion experiment using rock ilmenite as bed material was conducted in the Chalmers 12 $MW_{th}$ CFB boiler, FIG. 2. The boiler was operated using wood-chips as fuel and the temperature in the boiler was kept around 830-880° C. during the experiment. No discharge of the ilmenite in the form of bottom bed regeneration was carried out during the whole experiment, this is different compared to operation with ordinary silica sand where around 10-15 wt. % of the bed is discharged and replaced with fresh silica sand on a daily basis.

Fresh ilmenite was fed only to compensate for the fly ash losses. Samples of the bed material were collected in location H2 by using a water-cooled bed sampling probe, after 28, 107 and 296 hours. These samples were further evaluated in a lab-scale fluidized bed reactor system (see example 3).

EXAMPLE 3

Three samples of bottom bed from the Chalmers boiler (see Example 2) were chosen for the evaluation. The samples were collected in the combustor after 28, 107 and 296 hours of operation. All samples were tested separately in a lab-scale fluidized bed reactor in a cyclic mode according to the below-described principle of altering the environment between oxidizing and reducing environment. In addition to the three samples from the Chalmers boiler, fresh ilmenite particles from the same mine (Titania A/S) were tested as a reference. In this case, the activation of the ilmenite was conducted within the lab-scale reactor and the time period represents around 20 cycles. In the lab-scale reactor system the exposure time for the ilmenite is referred to as cycles meanwhile the exposer time with in a combustor would be referred to as minutes or hours. A rather harsh and conservative correlation between the cycles in the lab-scale reactor system and the residence time would be that 20 cycles within the reactor system corresponds to 1 hour of operation in a conventional FBC boiler.

With regards to the chemical impact and the chemical aging of ilmenite, the oxygen-carrying properties of the ilmenite and its reactivity towards oxidizing carbon monoxide (CO) into carbon dioxide ($CO_2$) have been examined.

The evaluation of the reactivity and oxygen transfer is based on experimental tests performed in a lab-scale fluidized reactor system, shown schematically in FIG. 4. All experiments are carried out in a fluidized bed quartz glass reactor with an inner diameter of 22 mm and an overall length of 870 mm. A porous quartz plate is mounted in the centre of the reactor and serves as gas distributor. The sample is weighed before the experiment and placed on the quartz plate at ambient conditions. 10-15 g of material with a particle size fraction of 125-180 μm is used.

Temperatures of 850, 900 and 950° C. have been investigated in the present study. The temperature is measured by a type K CrAl/NiAl thermocouple. The tip of the thermocouple is located about 25 mm above the porous plate to make sure that it is in contact with the bed when fluidization occurs. The thermocouple is covered by a quartz glass cover, protecting it from abrasion and the corrosive environment. The reactor is heated by an external electrical oven.

During heating and oxidation, the particles are exposed to a gas consisting of 21 vol. % $O_2$ diluted with nitrogen ($N_2$). After the desired temperature has been reached, the gas atmosphere is shifted from oxidizing to reducing conditions by changing the ingoing gas. In order to prevent combustion of fuel by oxygen from the oxidation phase as well as to prevent reduction gas in the beginning of the oxidation phase, both phases are separated by a 180 s inert period. During the inert period the reactor is flushed with pure nitrogen. The fuel gases as well as synthetic air are taken from gas bottles whereas the nitrogen ($N_2$) is supplied from a centralized tank. The fluidizing gas enters the reactor from the bottom. The gas composition is controlled by mass flow controllers and magnetic valves. The water content in the off gas is condensed in a cooler before the concentrations of CO, $CO_2$, $CH_4$, $H_2$ and $O_2$ are measured downstream in a gas analyser (Rosemount NGA 2000).

The reactivity of the materials as oxygen carriers were assessed through two main performance parameters—the oxygen carrier conversion (ω) and the resulting gas conversion ($y_{\bar{i}}$).

The conversion of the oxygen carrier is described by its mass-based conversion ω, according to $$\omega = \frac{m}{m_{ox}}$$

where m denotes the actual mass of the oxygen carrier and $m_{ox}$ is the mass of the oxidized oxygen carrier. It is assumed that the changes in the mass of the oxygen carrier originate only from the exchange of oxygen.

The oxygen carrier mass-based conversion is calculated as a function of time t from the mass balance of oxygen over the reactor:

$$syngas:\ \omega_t = \omega_{t-1} - \int_{t-1}^{t} \frac{\dot{n} - M_O}{m_{ox}} \cdot (2y_{\bar{C}O2} + y_{\bar{C}O} - y_{\bar{H}2} + 2y_{\bar{O}2})\, dt$$

$\dot{n}^{-}$ is the molar flow rate at the reactor outlet and $M_O$ the molar mass of oxygen.

The gas conversion $\gamma_{CO}$ for syngas is defined as follows:

$$\gamma_{CO} = \frac{y_{\bar{C}O2}}{y_{\bar{C}O2} + y_{\bar{C}O}}$$

$y_{\bar{i}}$ is the molar fraction of the components in the effluent gas stream. In order for ilmenite to reach its maximum performance it needs to be activated through several consecutive redox cycles. Therefore, the number of cycles needed for activation was also used as a performance parameter for choice of material as this number is indicative for the time point when the oxygen carrier reaches its full potential. In a CFB boiler the activation occurs naturally since the particles meet alternating reducing/oxidizing environments while circulating in the CFB loop.

FIG. 6 show the gas conversion of CO into $CO_2$ for three temperatures for the lab-scale experiments using the three bottom bed samples from the Chalmers boiler (Example 2) and for two temperatures for fresh ilmenite that was activated in the lab-scale reactor.

The lower line in FIG. 6 represents the experiments with the fresh ilmenite. The experiments using the three bottom bed samples collected at different times in the Chalmers give much higher gas conversion of CO to $CO_2$ than what was expected. In fact, the gas conversion for these samples are 15%-units higher than the one with the fresh ilmenite used as reference. The relatively good agreement in gas conversion between the three samples from the Chalmers boiler clearly highlights the effects initiated from long term operation in a FBC-boiler.

Overall, these data show the surprising result that the ilmenite could be used for at least 300 hours in a combustor. As the gas conversion is still much higher than for fresh particles after 300 hours the results indicate that it is possible to extend the residence time of the ilmenite particles significantly longer.

FIG. 7 shows the average oxygen carrier mass-based conversion for three temperatures for the lab-scale experiments using the three bottom bed samples from the Chalmers boiler (Example 2) and for two temperatures for the fresh ilmenite that was activated in the lab-scale reactor.

Again, the lower line in FIG. 7 represents the experiments with the fresh ilmenite. The Omega number for the three bottom bed samples from the Chalmers boiler is much higher than expected. The discovery in increased gas conversion agrees well with the increase in oxygen transfer and the omega number and the gas conversion is therefore supporting each other.

These experiments provide evidence that the ilmenite particles can be used as oxygen-carrier even after having been exposed to boiler conditions for an extended period of time, ranging up to at least 300 hours.

EXAMPLE 4a

The samples from the Chalmers boiler obtained in Example 2 and the fresh ilmenite were also tested in an attrition rig as described below.

Attrition index was measured in an attrition rig that consists of a 39 mm high conical cup with an inner diameter of 13 mm in the bottom and 25 mm in the top, see FIG. 5. At the bottom of the cup through a nozzle with an inner diameter of 1.5 mm (located at the bottom of the cup) air is added at a velocity of 10 l/min. Prior to the experiments the filter is removed and weighed. The cup is then dismantled and filled with 5 g of particles. Both parts are then reattached and the air flow is turned on for 1 hour. In order to get the development of fines during the attrition tests the air flow is stopped at chosen intervals and the filter is removed and weighed.

FIG. 8 shows the results from the attrition experiments for the experiments using the three bottom bed samples from the Chalmers boiler (see Example 2) and fresh ilmenite. FIG. 8 shows the surprising result that after an extended residence time of the particles in the boiler the rate of attrition for the particles decreases. This suggests that the mechanical strength of the particles is sufficient for recycling even after 296 hours in a fluidized bed boiler.

EXAMPLE 4b

FIG. 9, which shows electron micrographs of fresh rock ilmenite particles and rock ilmenite particles that have been exposed to a redox environment in the Chalmers CFB boiler for 24 hours.

The exposed rock ilmenite particles have smoother edges and are likely to produce less fines. Without wishing to be bound by theory, it is contemplated that this phenomenon is likely coupled to the particles being exposed to friction in between particles and boiler walls resulting in a much smoother and round surface than the fresh particles. The increased roundness leads to a less erosive surface which is less abrasive to the walls of the boiler.

EXAMPLE 5

FIG. 10 shows electron micrographs of ilmenite particles before and after exposure in a lab scale fluidized bed reactor, an overview of the cross-section and elemental maps of Iron (Fe) and Titanium (Ti) are shown for both cases. The overview of the particles (top) shows once again that the exposed particles become less sharp. From the micrographs (center) it can also be confirmed that the porosity of the particles increases with exposure, with some of the particles having multiple cracks in their structure. The elemental mapping (bottom, right) shows that the Fe and the Ti fraction is homogeneously spread within the fresh ilmenite particles. In comparison to the fresh particles the exposed ones (bottom, left) clearly indicate that the Fe is migrating towards the surface of the ilmenite particles while the Ti fraction is more homogeneously spread in the particle. The iron migration is schematically indicated in FIG. 1 and a desired mechanism since the invention has recognized that this increases the possibilities for efficient separation of the ilmenite particles by a magnetic process.

EXAMPLE 6

Magnetic separation was evaluated using bottom bed samples from an industrial scaled boiler operated with ilmenite as bed material. The 75 $MW_{th}$ municipal solid waste fired boiler was operated using ilmenite as bed material during more than 5 months. Several bottom bed samples were collected during this operating time. The fuel that is fed to this boiler commonly comprises 20-25 wt. % non-combustibles in the form of ash and the regeneration of the bottom bed is thereby a continuous process to remove alkali metals (Na, K) and coarse inorganic particles/lumps from the bed and any agglomerates formed during boiler operation, and to keep the differential pressure over the bed sufficient.

The potential of separating the ilmenite from the ash fraction was investigated for six arbitrary samples collected during the operation of the boiler. A 1 meter long half pipe made from a steel plate was used together with a magnet as indicated in FIG. 3. The magnet was placed on the backside of the halfpipe and the halfpipe was tilted in a≈45° angel with the bottom end resting in a metal vessel (1). (i), A portion of the sample, roughly 10-15 g, was poured into the halfpipe and the material was allowed to flow across the metal surface by gravity. When the material flowed across the surface where the magnet was acting on the steel plate, the ilmenite was captured and the ash fraction passed by and was captured in the metal vessel (1). (ii), The half pipe was moved to the metal vessel (2) and the magnet was removed and the ilmenite fraction was captured in the vessel (2).

Furthermore, magnetic separation of ilmenite particles and ash has been successfully tested for rock and sand ilmenite with the Chalmers boiler.

EXAMPLE 7

FIGS. 13, 14 and 15 show phase diagrams from FactSage calculations. Such diagrams show which compounds and phases of the compounds are stable under the conditions given in the calculation. FIG. 13 shows the composition versus the gaseous oxygen concentration at the temperature 1173 K, which is the normal combustion temperature in FB boilers. FIG. 14 shows the stable compounds and phases of Fe, Ti and O versus the concentration of Fe and Ti, also at 1173 K. FIG. 15 shows the stable compounds and phases between the pure oxides; FeO, $TiO_2$, and $Fe_2O_3$. For example, at high concentration of oxygen and no Ti, the stable compound is $Fe_2O_3$. At reducing condition (=low oxygen concentration) and no Ti, the stable compound is FeO.

The invention claimed is:

1. A method for operating a fluidized bed boiler, comprising carrying out a combustion process with a fluidized bed comprising ilmenite particles, wherein an average residence time of the ilmenite particles in the boiler is at least 100 hours.

2. The method of claim 1, wherein the average residence time of the ilmenite particles in the boiler is less than 600 hours.

3. The method of claim 1, further comprising:

a) removing at least one ash stream comprising ilmenite particles from the boiler;

b) separating ilmenite particles from the at least one ash stream.

4. The method of claim 3, characterized in that the separating comprises magnetically separating ilmenite particles and/or electrically separating ilmenite particles from the at least one ash stream.

5. The method of claim 4, characterized in that the ilmenite particles are electrically separated from the at least one ash stream by means of an electrostatic separator.

6. The method of claim 3, characterized in that steps a) and b) are carried out multiple times.

7. The method of claim 3, characterized in that the method further comprises a pre-selection step in which the particles in the at least one ash stream are pre-selected prior to the separating of step b) wherein the pre-selection step comprises mechanical particle separation and/or fluid driven particle separation.

8. The method of claim 3, characterized in that the at least one ash stream is selected from the group consisting of bottom ash stream, fly ash stream, boiler ash stream and filter ash stream.

9. The method of claim 3, further comprising c) recirculating separated ilmenite particles into a fluidized bed of the boiler.

10. The method of claim 1, further comprising feeding fresh ilmenite particles to the fluidized bed of the boiler at a rate compensating for ilmenite particles lost during removal of an ash stream from the boiler.

11. The method of claim 1, characterized in that the fluidized bed boiler is a bubbling fluidized bed boiler or a circulating fluidized bed boiler.

12. The method of claim 1, characterized in that the average residence time of the ilmenite particles in the boiler is between 200 hours and 500 hours.

13. The method of claim 1, characterized in that the average residence time of the ilmenite particles in the boiler is between 250 hours and 400 hours.

14. The method of claim 1, characterized in that the average residence time of the ilmenite particles in the boiler is between 300 hours and 350 hours.

15. The method of claim 7, wherein the pre-selection step further comprises one or more of:

sieving particle separation; and/or gas-driven particle separation.

16. The method of claim 8, characterized in that the at least one ash stream is selected from the group consisting of bottom ash stream and fly ash stream.

17. The method of claim 9, wherein steps a), b), and c) are carried out multiple times.

18. The method of claim 10, wherein the removed ash stream comprises fly ash and/or bottom ash.

* * * * *